US012612282B2

(12) United States Patent
Yokoyama et al.

(10) Patent No.: US 12,612,282 B2
(45) Date of Patent: Apr. 28, 2026

(54) CARD ISSUING DEVICE

(71) Applicant: NIDEC INSTRUMENTS CORPORATION, Nagano (JP)

(72) Inventors: Satoshi Yokoyama, Nagano (JP); Keiji Ohta, Nagano (JP)

(73) Assignee: NIDEC INSTRUMENTS CORPORATION, Nagano (JP)

( * ) Notice: Subject to any disclaimer, the term of this patent is extended or adjusted under 35 U.S.C. 154(b) by 208 days.

(21) Appl. No.: 18/467,189

(22) Filed: Sep. 14, 2023

(65) Prior Publication Data

US 2024/0092607 A1 Mar. 21, 2024

(30) Foreign Application Priority Data

Sep. 20, 2022 (JP) ..... 2022-148836

(51) Int. Cl.
*B65H 43/08* (2006.01)
*B65H 1/06* (2006.01)

(52) U.S. Cl.
CPC ..... *B65H 43/08* (2013.01); *B65H 1/06* (2013.01); *B65H 2553/40* (2013.01); *B65H 2553/81* (2013.01); *B65H 2557/63* (2013.01); *B65H 2601/2611* (2013.01); *B65H 2701/1914* (2013.01)

(58) Field of Classification Search
CPC ..... B65H 43/08; B65H 1/06; B65H 2553/40; B65H 2557/63; B65H 2601/2611; B65H 2701/1914
USPC ..... 221/9
See application file for complete search history.

(56) References Cited

U.S. PATENT DOCUMENTS 1,633,937 A * 6/1927 Ford ..... B65H 3/60 271/146
3,540,247 A * 11/1970 Lucien ..... G01B 5/068 72/9.2
3,957,175 A * 5/1976 Gordon ..... G07F 11/045 221/250
5,045,674 A * 9/1991 Mita ..... G06K 7/0026 235/475
5,051,838 A * 9/1991 Cho ..... H04N 1/00 358/401
5,232,123 A * 8/1993 Richardson ..... G07F 11/22 221/259
5,300,763 A * 4/1994 Ito ..... G06K 13/08 235/475

(Continued)

FOREIGN PATENT DOCUMENTS

JP 2007041635 A 2/2007

*Primary Examiner* — Rakesh Kumar
(74) *Attorney, Agent, or Firm* — CANTOR COLBURN LLP

(57) ABSTRACT

A card issuing device for using with a plurality of cards includes a card storage part which accommodates the plurality of cards, a card send-out mechanism which sends out a card among the plurality of cards from the card storage part, a card conveyance mechanism which conveys the card sent out by the card send-out mechanism toward a card discharge port along a card conveyance passage connected with the card discharge port, an optical sensor which is located on a lower side with respect to the card conveyance passage and reads a code indicated on a rear face of the card, and a dust adhesion prevention mechanism which prevents dust from adhering to a reading face of the optical sensor when the optical sensor is not used.

7 Claims, 11 Drawing Sheets

(56) References Cited

U.S. PATENT DOCUMENTS 5,335,816 A * 8/1994 Kaufman ..... G07F 11/14 221/124
5,409,205 A * 4/1995 Macke, Sr. ..... B65H 3/02 270/52.18
5,439,136 A * 8/1995 Chatani ..... G07F 11/22 221/270
5,531,355 A * 7/1996 Ullmann ..... G07F 11/045 221/229
5,562,402 A * 10/1996 Muto ..... B65H 9/101 221/277
5,743,521 A * 4/1998 Munakata ..... G03G 15/5029 271/265.04
5,842,598 A * 12/1998 Tsuchida ..... G07F 11/22 74/109
5,857,588 A * 1/1999 Kasper ..... E05B 35/008 221/232
5,929,426 A * 7/1999 May ..... G06K 13/08 235/475
5,938,073 A * 8/1999 Chang ..... B65H 3/063 221/277
5,941,414 A * 8/1999 Kasper ..... G07F 17/42 221/210
5,978,626 A * 11/1999 Nagamine ..... G03G 21/1628 399/125
6,029,971 A * 2/2000 Lynch ..... G07D 11/10 221/21
6,070,023 A * 5/2000 Kataoka ..... G03G 15/6514 399/45
6,098,840 A * 8/2000 Ito ..... B65H 3/24 221/217
6,324,355 B1 * 11/2001 Matsui ..... G03G 15/0194 399/167
7,607,580 B2 * 10/2009 Takita ..... G06K 13/08 235/440
7,841,783 B2 * 11/2010 Harvey ..... G03B 17/00 396/428
8,684,156 B1 * 4/2014 Chang ..... G07D 7/121 194/344
10,185,846 B2 * 1/2019 Miyazawa ..... G06K 13/0806
10,271,666 B2 * 4/2019 Taylor ..... A47F 1/125
10,599,089 B2 * 3/2020 Kasuga ..... H04N 1/00745
10,981,739 B2 * 4/2021 Morikawa ..... B65H 31/02
11,186,096 B2 * 11/2021 Ohta ..... B41J 29/00
11,754,956 B2 * 9/2023 Yang ..... G01B 7/06 399/45
11,839,534 B2 * 12/2023 Morad ..... G07F 11/045
12,242,907 B2 * 3/2025 Yokoyama ..... G06K 7/10316
2005/0003889 A1 * 1/2005 Dabrowski ..... G07F 17/3251 463/25
2007/0160358 A1 * 7/2007 Kashiyama ..... G03B 9/62 396/235
2011/0042403 A1 * 2/2011 Martin ..... B65H 5/04 221/124
2014/0263385 A1 * 9/2014 Martin ..... B65H 3/24 221/232
2015/0277320 A1 * 10/2015 Tani ..... G03G 15/5054 399/74
2024/0092607 A1 * 3/2024 Yokoyama ..... G06K 13/14

* cited by examiner

CARD ISSUING DEVICE

CROSS REFERENCE TO RELATED APPLICATION

The present invention claims priority under 35 U.S.C. § 119 to Japanese Application No. 2022-148836 filed Sep. 20, 2022, the entire content of which is incorporated herein by reference.

TECHNICAL FIELD

At least an embodiment of the present invention may relate to a card issuing device structured to issue a card on which a code such as a bar code is printed.

BACKGROUND

A card issuing device structured to issue a card on which magnetic information is recorded is described in Japanese Patent Laid-Open No. 2007-041635 (Patent Literature 1). The card issuing device described in the literature includes a card storage part having a plurality of card cassettes in which cards are accommodated, a card processing part in which reading and writing processing of magnetic information is performed on a card, and a card conveyance part which conveys a card sent out from each of the card cassettes to the card processing part. The card storage part, the card conveyance part and the card processing part are arranged in this order in an orthogonal direction perpendicular to an arrangement direction in which a plurality of the card cassettes are arranged.

The card storage part includes a card send-out mechanism which sends out a card one by one from each card cassette toward the card conveyance part. The card conveyance part includes a carriage and a card conveyance mechanism which moves the carriage in the arrangement direction. The carriage includes a conveyance part which takes a card sent out from a card cassette to hold the card in the carriage and sends out the card from the carriage to the card processing part.

When a card is to be issued, first the card issuing device drives the card conveyance mechanism to arrange the carriage at a position facing a predetermined card cassette. Further, the card issuing device drives the card send-out mechanism to send out a card from the predetermined card cassette in the orthogonal direction and drives the conveyance part to take the card sent out from the card cassette into the carriage. Then, the card issuing device drives the card conveyance mechanism to move the carriage to a position facing the card processing part. After that, the card issuing device drives a drive part to send the card from the carriage into the card processing part. The card processing part reads magnetic information recorded on the card by a card reader and records necessary information to the card. The card issuing device discharges (issue) the card from the card processing part.

When a card on which a bar code is printed is to be issued as a member card or the like, there is a case that the bar code is read when the card is to be issued and information of the bar code having been read is associated with information of a member who is an owner of the card.

In a case that a bar code reading function is to be added to the card issuing device described in Patent Literature 1, it is conceivable that an optical sensor having a bar code reader is provided between the card conveyance part and the card processing part. In this case, when a face on which the bar code of the card is printed is directed to a lower side, it is conceivable that the optical sensor is arranged on a lower side with respect to the card conveyance part so that a reading face of the optical sensor is directed to an upper side. According to this structure, the optical sensor is capable of reading a bar code of a card from a lower side. However, in a case that this structure is adopted, dust is accumulated on a reading face of the optical sensor when the optical sensor is not used and thus, optical performance of the optical sensor may be lowered.

Further, in a case that a face of a card on which a bar code is printed is directed to a lower side, it is conceivable that an optical sensor is arranged on an upper side with respect to the card conveyance part so that a reading face of the optical sensor is directed to a lower side and a reversal mechanism for reversing the card is provided. According to this structure, after the reversal mechanism reverses the face on which the bar code of the card is printed from a lower side to an upper side, the optical sensor is capable of reading the bar code of the card from an upper side. However, when this structure is adopted, the reversal mechanism is provided and thus, a size of the card issuing device is increased.

SUMMARY

In view of the problem described above, at least an embodiment of the present invention may advantageously provide a card issuing device capable of restraining reduction in optical performance of an optical sensor and increase in size of a card issuing device even in a case that a face of a card on which a bar code is printed is directed to a lower side.

According to at least an embodiment of the present invention, there may be provided a card issuing device including a card storage part which accommodates a plurality of cards, a card send-out mechanism which sends out a card from the card storage part, a card conveyance mechanism which conveys the card sent out by the card send-out mechanism toward a card discharge port along a card conveyance passage connected with the card discharge port, an optical sensor which is located on a lower side with respect to the card conveyance passage and reads a code indicated on a rear face of the card, and a dust adhesion prevention mechanism which prevents dust from adhering to a reading face of the optical sensor when the optical sensor is not used.

According to at least an embodiment of the present invention, the optical sensor is located on a lower side with respect to the card conveyance passage. Therefore, the optical sensor is capable of reading a card whose rear face is indicated with a code. Further, the dust adhesion prevention mechanism prevents dust from adhering to the reading face of the optical sensor when the optical sensor is not used and thus, reduction of optical performance of the optical sensor due to dust can be suppressed.

In the embodiment of the present invention, it is preferable that the dust adhesion prevention mechanism is a turning mechanism which turns the optical sensor between a first position where the reading face of the optical sensor is directed to an upper side and a second position where the reading face is directed to a lower side. According to this structure, the turning mechanism is capable of setting the reading face of the optical sensor to the first position where the reading face is directed to an upper side when the optical sensor is used and, when the optical sensor is not used, the turning mechanism is capable of setting the reading face of the optical sensor to the second position where the reading face is directed to a lower side. Therefore, when the optical sensor is not used, the reading face of the optical sensor is directed to a lower side and thus, dust can be restrained from adhering to the reading face of the optical sensor. As a result, optical performance of the optical sensor can be restrained from being lowered due to dust. Further, the turning mechanism turns the optical sensor from the first position to the second position and thus, dust adhered to the reading face of the optical sensor when the optical sensor is used can be dropped to a lower side.

In the embodiment of the present invention, it is preferable that the turning mechanism includes a holder which holds the optical sensor and a drive part which turns the holder between the first position and the second position with a turning axis as a center, the holder is provided with a protruded part which is protruded to an outer side in a radial direction with respect to the turning axis, the optical sensor includes a flexible wiring board which is extended to the outer side in the radial direction, and the flexible wiring board is fixed to the protruded part. According to this structure, the flexible wiring board is fixed to the protruded part and thus, when the holder is turned, a force applied to the flexible wiring board can be restrained from applying to a root of the flexible wiring board. As a result, the flexible wiring board can be restrained from disengaging from the optical sensor.

In the embodiment of the present invention, it is preferable that the holder is provided with a bent part which is bent from a tip end portion of the protruded part in a circumferential direction with respect to the turning axis and, when the holder is turned from the first position to the second position or, when the holder is turned from the second position to the first position, the flexible wiring board is bent along the bent part. According to this structure, when the turning mechanism turns the holder, the bent part functions as a guide for bending the flexible wiring board and thus, the flexible wiring board is easily bent.

In the embodiment of the present invention, it is preferable that the card issuing device includes a position detection sensor which detects that the optical sensor is located at the first position and the second position, and a control part which drives and controls the card send-out mechanism, the card conveyance mechanism, the optical sensor and the turning mechanism. The control part controls the turning mechanism based on a detection result of the position detection sensor and, when the position detection sensor detects that the optical sensor is located at the first position, the control part drives the optical sensor to read the code. According to this structure, a position of the optical sensor can be detected by the position detection sensor and thus, in comparison with a structure that a position of the optical sensor is detected by using a stepping motor or the like provided in the turning mechanism, control and structure can be simplified. Further, the control part is capable of driving the optical sensor based on a detection result of the position detection sensor and thus, the optical sensor can be easily driven and controlled.

In the embodiment of the present invention, it is preferable that, when the control part drives the optical sensor to perform a reading operation of the code and, in a case that the optical sensor has failed to read the code, the control part drives the turning mechanism to turn the holder for finely adjusting the first position of the optical sensor and drives the optical sensor to read the code again. According to this structure, a reading direction of the optical sensor can be finely adjusted and thus, when the optical sensor reads the code again, failure of reading of the code can be suppressed.

In the embodiment of the present invention, it is preferable that the dust adhesion prevention mechanism is a shutter mechanism which moves a shading member between a first position where the reading face of the optical sensor is exposed and a second position where the reading face is covered. According to this structure, when the optical sensor is not used, the reading face of the optical sensor is covered by the shading member and thus, dust can be prevented from adhering to the reading face of the optical sensor.

Effects of the Invention

According to the present invention, the optical sensor is located on a lower side with respect to the card conveyance passage. Therefore, the optical sensor is capable of reading a card whose rear face is indicated with a code. Further, the dust adhesion prevention mechanism prevents dust from adhering to the reading face of the optical sensor when the optical sensor is not used and thus, reduction of optical performance due to dust of the optical sensor can be suppressed.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

A card issuing device in accordance with an embodiment of the present invention will be described below with reference to the accompanying drawings. In the following descriptions, three directions perpendicular to each other are defined as an "X" direction, a "Y" direction and a "Z" direction. Further, one side in the "X" direction is referred to as an "X1" direction side, and the other side is referred to as an "X2" direction side. One side in the "Y" direction is referred to as a "Y1" direction side, and the other side is referred to as a "Y2" direction side. One side in the "Z" direction is referred to as a "Z1" direction side, and the other side is referred to as a "Z2" direction side. The "X" direction is a front and rear direction of a card issuing device. The "X1" direction side is a front side, and the "X2" direction side is a rear side. The "Y" direction is a width direction of a card issuing device. The "Y1" direction side is one side in the width direction, and the "Y2" direction side is the other side in the width direction. The "Z" direction is an upper and lower direction of a card issuing device. The "Z1" direction side is a lower side, and the "Z2" direction side is an upper side.

First Embodiment (Entire Structure)

Figure 1:
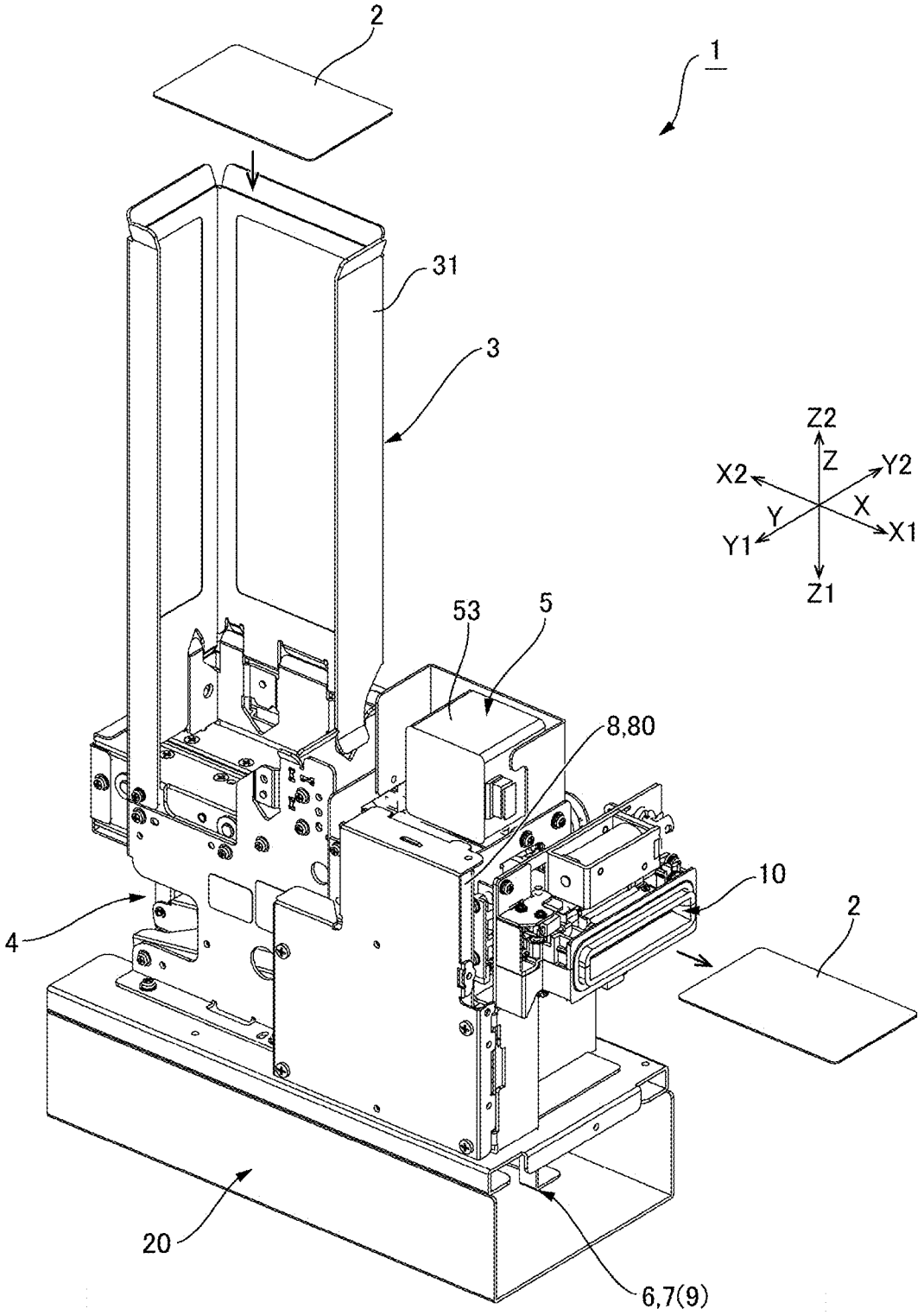
FIG. 1 is an outward perspective view showing a card issuing device which is viewed from an upper side in accordance with an embodiment of the present invention.
Figure 2:
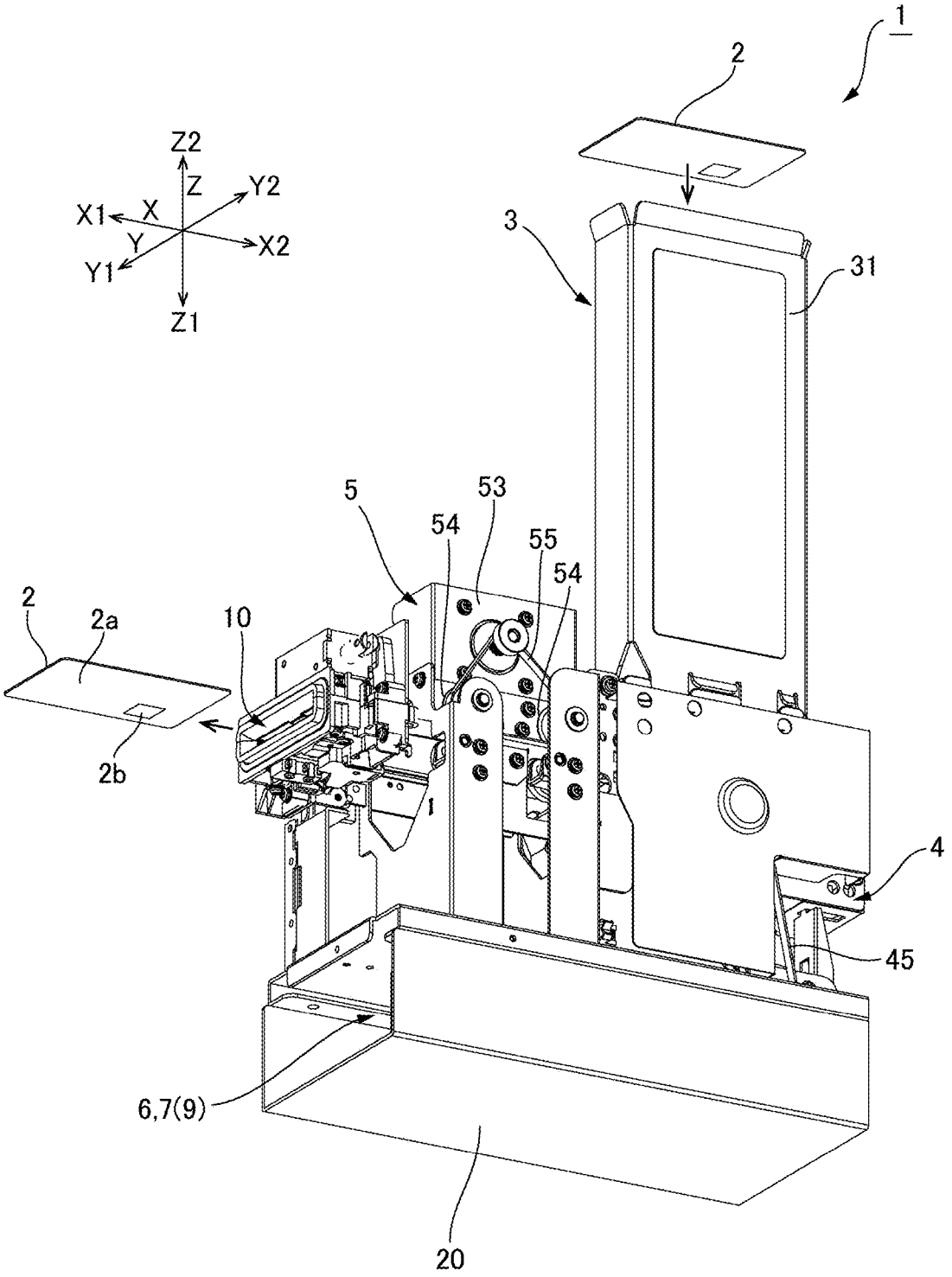
FIG. 2 is an outward perspective view showing a card issuing device which is viewed from a lower side.
Figure 3:
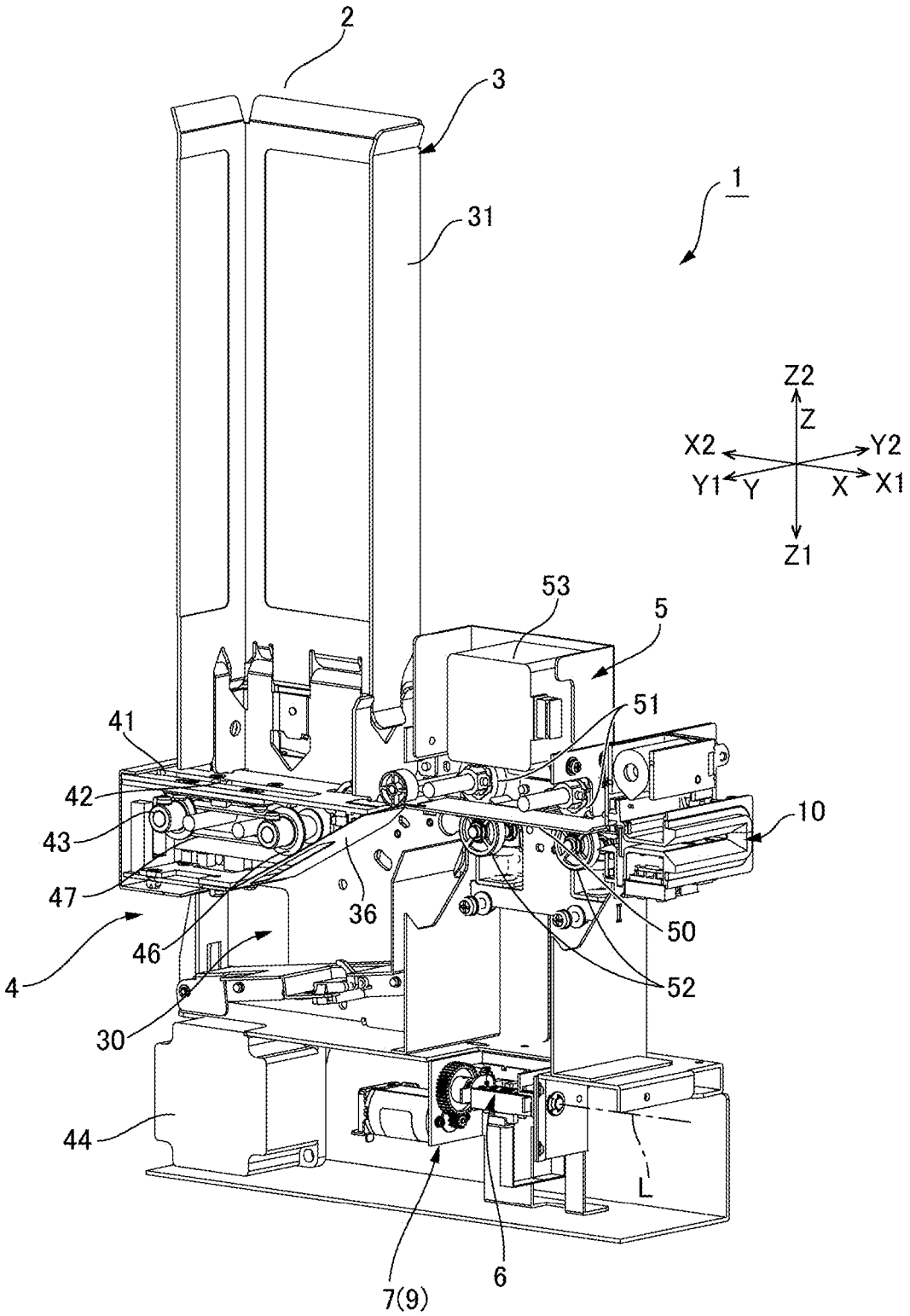
FIG. 3 is a cross-sectional perspective view showing a card issuing device.
Figure 4:
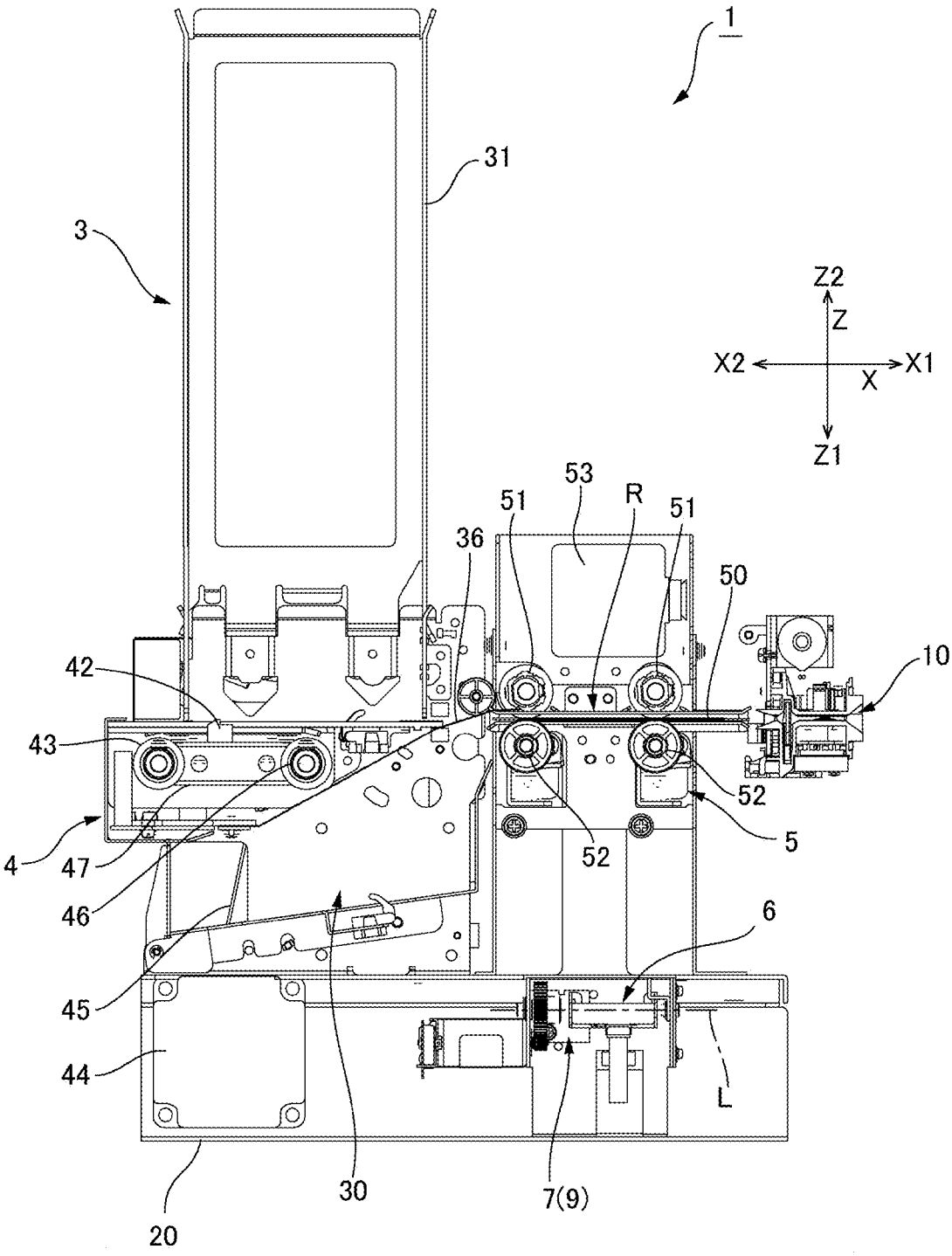
FIG. 4 is a cross-sectional view showing a card issuing device.

FIG. 1 is an outward perspective view showing a card issuing device 1 which is viewed from an upper side in accordance with an embodiment of the present invention. FIG. 2 is an outward perspective view showing the card issuing device 1 which is viewed from a lower side. FIG. 3 is a cross-sectional perspective view showing the card issuing device 1. FIG. 4 is a cross-sectional view showing the card issuing device 1.

The card issuing device 1 shown in FIG. 1 and FIG. 2 is communicably connected with a host apparatus not shown and used. The card issuing device 1 issues a card 2 indicated with a code 2*b* on its rear face 2*a* as a member card based on a card issuing instruction from the host apparatus. The code 2*b* is a bar code which is a one-dimensional code or a quick response (QR) code (registered trademark) which is a two-dimensional code.

As shown in FIG. 1 through FIG. 4, the card issuing device 1 includes a card storage part 3 which accommodates a plurality of cards 2 before issue, a card send-out mechanism 4 structured to send out a card 2 from the card storage part 3, a card conveyance mechanism 5 structured to convey a card 2 sent out by the card send-out mechanism 4 toward a card discharge port 10, an optical sensor 6 which is located on the "Z1" direction side with respect to the card conveyance passage 50 and reads a code 2*b* indicated on a rear face 2*a* of the card 2, and a dust adhesion prevention mechanism 9 structured to prevent dust from adhering to the reading face 60 of the optical sensor 6 when the optical sensor 6 is not used. In this embodiment, the dust adhesion prevention mechanism 9 is a turning mechanism 7 structured to turn the optical sensor 6 with a turning axis "L" as a center.

As shown in FIG. 1, the card issuing device 1 includes a control part 8. The control part 8 controls the card send-out mechanism 4, the card conveyance mechanism 5, the optical sensor 6 and the turning mechanism 7. The control part 8 is disposed on the "Y1" direction side with respect to the card conveyance mechanism 5. The control part 8 includes a board 80 on which circuits provided with a central processing unit (CPU), a read-only memory (ROM), a random-access memory (RAM) and the like are mounted.

(Card Storage Part)

As shown in FIG. 1 and FIG. 2, the card storage part 3 includes a card stack part 31. The card stack part 31 is extended in the "Z" direction in a rectangular parallelepiped shape, and a part on the "Y1" direction side of the card stack part 31 is opened. A plurality of cards is accommodated in an inside of the card stack part 31. Cards 2 are accommodated into the card stack part 31 from the "Z2" direction side.

(Card Send-Out Mechanism)

Figure 5:
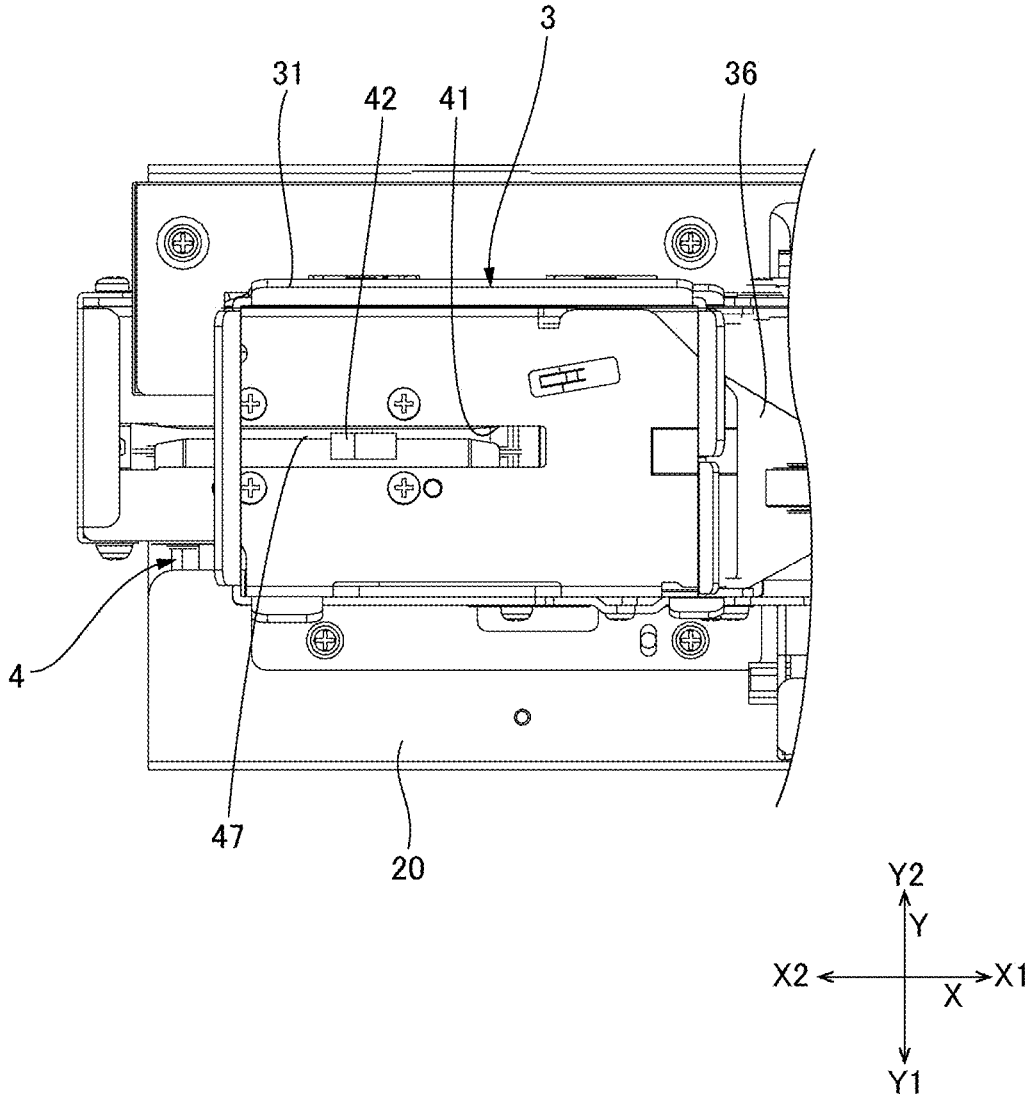
FIG. 5 is a plan view showing a card storage part and a card send-out mechanism.

FIG. 5 is a plan view showing the card storage part 3 and the card send-out mechanism 4. As shown in FIG. 4, the card send-out mechanism 4 is provided on the "Z1" direction side with respect to the card storage part 3. The card send-out mechanism 4 is attached to the "X2" direction side of a base member 20. The card send-out mechanism 4 discharges a lowest card 2 of cards 2 stacked in the card stack part 31 to the "X1" direction side. As shown in FIG. 5, the card send-out mechanism 4 includes a slit 41 extended in the "X" direction which is provided in a bottom face of the card stack part 31, and a card discharge pawl 42 which is disposed in the slit 41. The card discharge pawl 42 is capable of engaging with an edge of a card 2 located at the lowest position among the cards 2 stacked in the card stack part 31 from the "X2" direction side.

As shown in FIG. 4, the card send-out mechanism 4 includes a chain drive mechanism 43 which moves the card discharge pawl 42 in the "X" direction, and a motor 44 which drives the chain drive mechanism 43. As shown in FIG. 2, a drive force of the motor 44 is transmitted to a drive pulley 46 of the chain drive mechanism 43 through a belt 45. When the drive pulley 46 is rotated, a chain 47 engaged with the drive pulley 46 is driven. The card discharge pawl 42 is fixed to the chain 47.

In this embodiment, a collection part 30 is provided on the "Z1" direction side with respect to the card stack part 31. A card 2 which is returned to the "X2" direction side from the card conveyance mechanism 5 is sent into the collection part 30 by a guide member 36. The guide member 36 is a plate member having elasticity. When the card send-out mechanism 4 sends out a card 2 to the "X1" direction side, the guide member 36 is depressed to the "Z1" direction side by abutting with the card 2, and the card 2 is sent out to the card conveyance mechanism 5. When the card 2 has been sent out, the guide member 36 returns to the "Z2" direction side to be in a state that a card 2 which is to be returned to the "X2" direction side from the card conveyance mechanism 5 is capable of being guided to the collection part 30.

(Card Conveyance Mechanism)

As shown in FIG. 4, the card conveyance mechanism 5 conveys a card 2 along a card conveyance passage 50 which is connected with the card discharge port 10. The card discharge port 10 is disposed on the "X1" direction side with respect to the card conveyance mechanism 5. The card conveyance passage 50 is extended in the "X" direction from the "X1" direction side of the card send-out mechanism 4 to the card discharge port 10. The card conveyance passage 50 is set with a reading position "R" where the optical sensor 6 reads a code 2*b* which is indicated on a rear face 2*a* of a card 2.

The card conveyance mechanism 5 is attached to the "X1" direction side of the base member 20. The card conveyance mechanism 5 includes two drive rollers 51 disposed along the card conveyance passage 50, two driven rollers 52 disposed along the card conveyance passage 50, and a motor 53 which rotates the drive rollers 51. The drive rollers 51 are located on the "Z2" direction side of the card conveyance passage 50. The driven rollers 52 are located on the "Z1" direction side of the card conveyance passage 50 and face the drive rollers 51. As shown in FIG. 2, the drive roller 51 is connected with a drive pulley 54 through a shaft. A drive force of the motor 53 is transmitted to the drive pulleys 54 through a belt 55. When the drive pulley 54 is rotated, the drive roller 51 is rotated together with the drive pulley 54. A card 2 is moved along the card conveyance passage 50 by rotating the drive roller 51.

(Optical Sensor)

Figure 6:
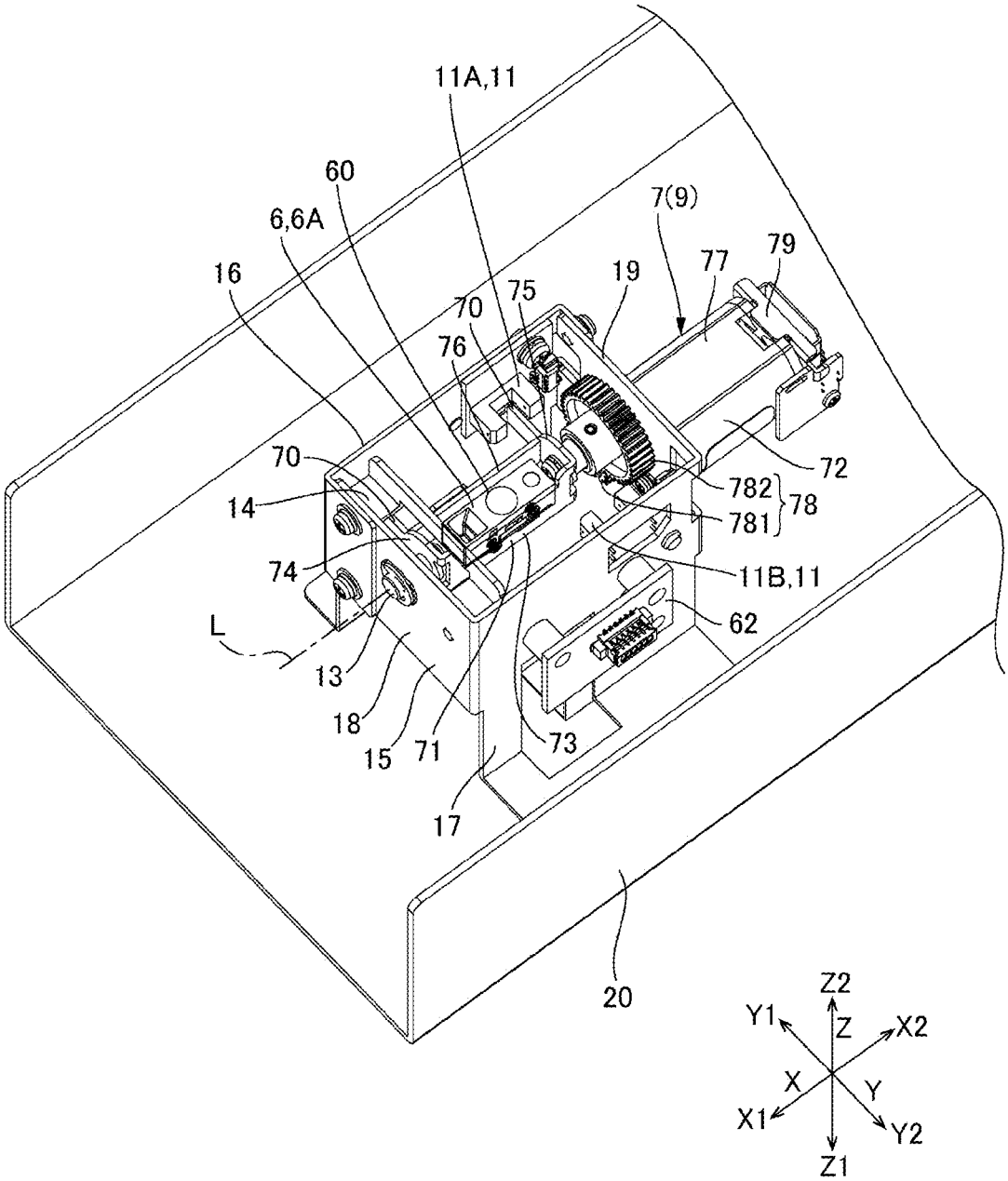
FIG. 6 is a perspective view showing an optical sensor and a turning mechanism which are viewed from one side.
Figure 7:
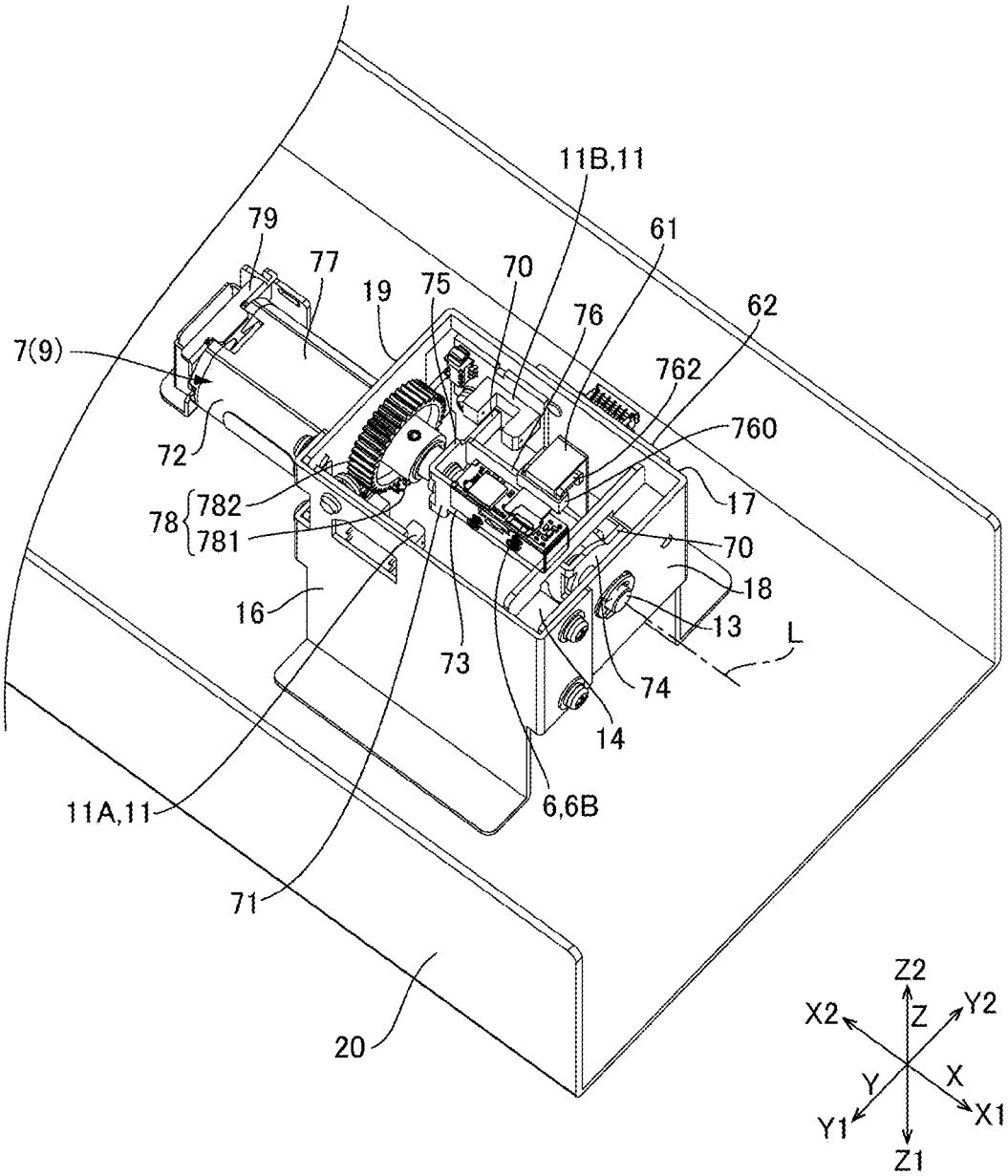
FIG. 7 is a perspective view showing an optical sensor and a turning mechanism which are viewed from the other side.

FIG. 6 is a perspective view showing the optical sensor 6 and the turning mechanism 7 which are viewed from one side. FIG. 7 is a perspective view showing the optical sensor 6 and the turning mechanism 7 which are viewed from the other side.

The optical sensor 6 shown in FIG. 6 is, for example, provided with an image sensor. As shown in FIG. 4, the optical sensor 6 is located on the "Z1" direction side with respect to the reading position "R" of the card conveyance passage 50 to irradiate an illumination light toward a card 2 and acquire an image of a code 2*b* and then, information of the code 2*b* is acquired by image analysis. When the optical sensor 6 reads information from the card 2, the read information is transmitted to the host apparatus.

As shown in FIG. 6 and FIG. 7, the optical sensor 6 is turned by the turning mechanism 7 between a first position 6A where the reading face 60 is directed to the "Z2" direction side and a second position 6B where the reading face 60 is directed to the "Z1" direction side. The reading face 60 is, for example, a lens or a cover glass.

The optical sensor 6 includes a flexible wiring board 61 which is extended to an outer side in a radial direction. The flexible wiring board 61 is electrically connected with a board 62. The board 62 is electrically connected with the board 80 through a flexible wiring board or the like. The board 62 is attached to a support member 15. The support member 15 is fixed to the base member 20. The support member 15 is provided with a first wall part 16, a second wall part 17, a third wall part 18 and a fourth wall part 19 which form a rectangular frame shape. The first wall part 16 is located on the "Y1" direction side and faces the second wall part 17. The first wall part 16 and the second wall part 17 are fixed to the base member 20 and are extended from the base member 20 to the "Z2" direction side. The third wall part 18 is bent from an end part on the "X1" direction side of the second wall part 17 to the "Y1" direction side and is connected with a portion which is bent from an end part on the "X1" direction side of the first wall part 16 to the "Y2" direction side by a screw. The fourth wall part 19 is bent from an end part on the "X2" direction side of the second wall part 17 to the "Y1" direction side and is connected with a portion which is bent from an end part on the "X2" direction side of the first wall part 16 to the "Y2" direction side by a screw. The board 62 is attached to a face on the "Y2" direction side of the second wall part 17.

(Turning Mechanism)

Figure 8:
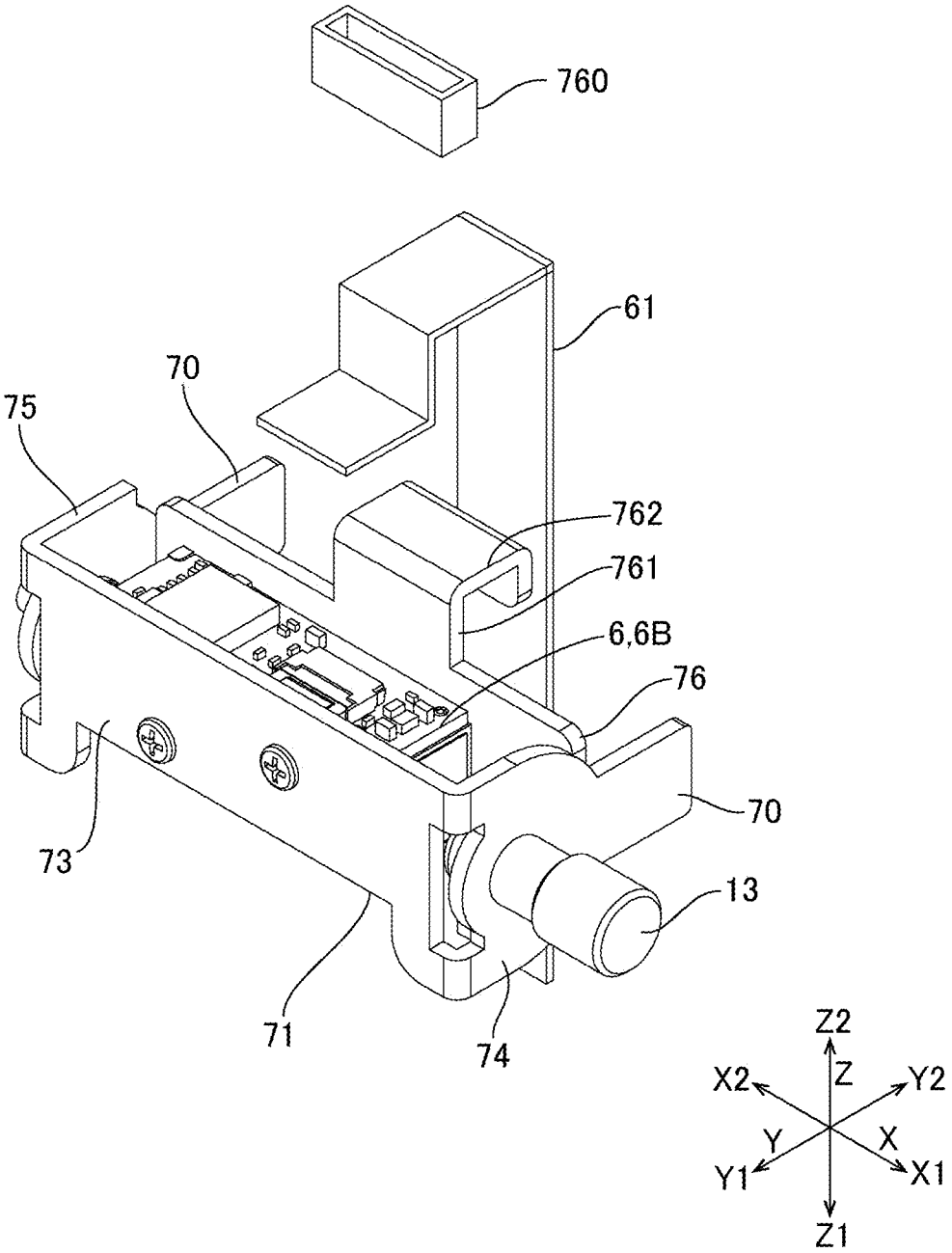
FIG. 8 is an exploded perspective view showing an optical sensor and a holder.

FIG. 8 is an exploded perspective view showing the optical sensor 6 and a holder 71. As shown in FIG. 6 and FIG. 7, the turning mechanism 7 is fixed to the support member 15. The turning mechanism 7 includes the holder 71 which holds the optical sensor 6 and a drive part 72 which turns the holder 71 between the first position 6A and the second position 6B with the turning axis "L" as a center. As shown in FIGS. 6, FIG. 7 and FIG. 8, the holder 71 is provided with a first plate part 73, a second plate part 74 which is bent in a radial direction from an end part on the "X1" direction side of the first plate part 73, a third plate part 75 which is bent in the radial direction from an end part on the "X2" direction side of the first plate part 73, and a fourth plate part 76 which faces the first plate part 73. As shown in FIGS. 6 and FIG. 7, the holder 71 is capable of turning with the turning axis "L" as a center in a state that the second plate part 74 is supported by the third wall part 18 through a shaft member 13 and the third plate part 75 is connected with a shaft part of an output gear 782 by a screw.

Each of the second plate part 74 and the third plate part 75 is provided with a protruded part 70 which is protruded to an outer side in the radial direction with respect to the fourth plate part 76. The optical sensor 6 is fixed to the first plate part 73 by a screw. As shown in FIG. 7 and FIG. 8, the fourth plate part 76 is provided with a protruded part 761 which is protruded to an outer side in the radial direction, and a bent part 762 which is bent in a circumferential direction from a tip end portion of the protruded part 761. The protruded part 761 is protruded to an opposite side to a side to which the reading face 60 of the optical sensor 6 is directed. The flexible wiring board 61 is fixed to the protruded part 761 by a fixing member 760. In this embodiment, the fixing member 760 is a binding band. In accordance with an embodiment of the present invention, the fixing member 760 is not limited to a binding band. The fixing member 760 may be, for example, a double sided tape or an adhesive. Further, as shown in FIG. 7, when the holder 71 is turned from the first position 6A to the second position 6B, the flexible wiring board 61 is bent along the bent part 762.

As shown in FIG. 6 and FIG. 7, the drive part 72 includes a motor 77 and a gear train 78 for transmitting a drive force of the motor 77 to the holder 71. The motor 77 is a DC motor and includes an encoder 79. The motor 77 is fixed to the fourth wall part 19 by a screw. The gear train 78 includes a pinion 781 fixed to an output shaft of the motor 77 and an output gear 782 which is engaged with the pinion 781. The "X1" direction side of the shaft part of the output gear 782 is connected with the holder 71 by a screw. The "X2" direction side of the shaft part of the output gear 782 is turnably supported by the fourth wall part 19.

In this embodiment, the support member 15 is provided with a position detection sensor 11 which detects that the optical sensor 6 is located at the first position 6A and the second position 6B. In this embodiment, the position detection sensor 11 is a transmission type photosensor. The position detection sensor 11 is electrically connected with the board 80 through a flexible wiring board or the like. The position detection sensor 11 includes a position detection sensor 11A provided on a face on the "Y2" direction side of the first wall part 16, and a position detection sensor 11B provided on a face on the "Y1" direction side of the second wall part 17. When the protruded part 70 of the third plate part 75 blocks light of the position detection sensor 11A at the first position 6A, the position detection sensor 11A detects that the optical sensor 6 is located at the first position 6A. When the protruded part 70 of the third plate part 75 blocks light of the position detection sensor 11B at the second position 6B, the position detection sensor 11B detects that the optical sensor 6 is located at the second position 6B.

The control part 8 drives the turning mechanism 7 based on a detection result of the position detection sensor 11. In other words, in a case that the holder 71 is to be turned from the first position 6A to the second position 6B, the control part 8 drives the turning mechanism 7 until the position detection sensor 11B detects the holder 71. Further, in a case that the holder 71 is to be turned from the second position 6B to the first position 6A, the control part 8 drives the turning mechanism 7 until the position detection sensor 11A detects the holder 71.

Further, the support member 15 is provided with a restriction member 14. The restriction member 14 is located on the "Z2" direction side with respect to the holder 71 and is fixed to a face on the "X2" direction side of the third wall part 18.

When the restriction member 14 is abutted with the protruded part 70 of the second plate part 74, a turning range of the holder 71 is restricted.

(Operation of Card Issuing Device)

Figure 9:
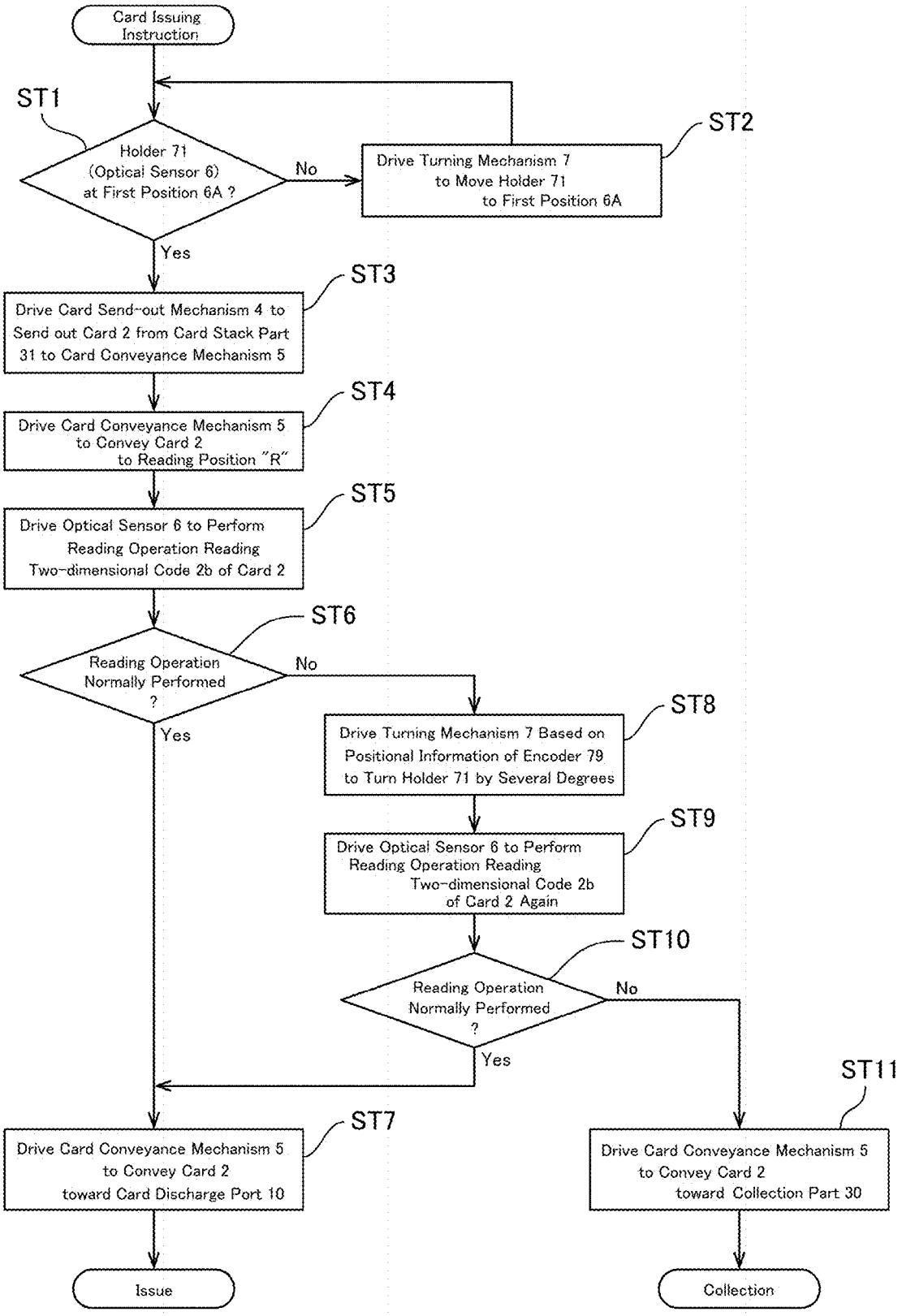
FIG. 9 is a flow chart showing a card issuing operation which issues a card.

Next, an operation of the card issuing device 1 will be described below. FIG. 9 is a flow chart showing a card issuing operation which issues a card 2. When a card 2 is to be issued, a card issuing instruction is transmitted to the card issuing device 1 from the host apparatus. The card issuing instruction is inputted into the control part 8.

As shown in FIG. 9, the control part 8 acquires information from the position detection sensor 11A whether the holder 71 is located at the first position 6A or not (operation "ST1"). In a case that the holder 71 is not located at the first position 6A (operation "ST1": "No"), the control part 8 drives the turning mechanism 7 to move the holder 71 to the first position 6A until the position detection sensor 11A detects the holder 71 (operation "ST2"). After that, the procedure is returned to the operation "ST1".

In a case that the holder 71 is located at the first position 6A (operation "ST1": "Yes"), the control part 8 drives the card send-out mechanism 4 to send out a card 2 from the card stack part 31 to the card conveyance mechanism 5 (operation "ST3").

When the card 2 is sent out to the card conveyance mechanism 5, the control part 8 drives the card conveyance mechanism 5 to convey the card 2 to the reading position "R" (operation "ST4"). Next, the control part 8 drives the optical sensor 6 to perform a reading operation in which a code 2*b* of the card 2 is read (operation "ST5").

In this embodiment, in a case that information having been read by the optical sensor 6 is transmitted to the host apparatus, the control part 8 determines that reading of information from the card 2 has been normally performed (operation "ST6": "Yes"). Next, the control part 8 drives the card conveyance mechanism 5 to convey the card 2 toward the card discharge port 10 (operation "ST7"). As a result, issue of the card 2 is completed.

In a case that the information having been read by the optical sensor 6 is not transmitted to the host apparatus, the control part 8 determines that reading of information from the card 2 has failed (operation "ST6": "No"). In this case, it is conceivable that an irradiation angle of an illumination light of the optical sensor 6 which is irradiated toward the card 2 is not appropriate and thus, the optical sensor 6 is unable to read the code 2*b*. Therefore, the control part 8 drives the turning mechanism 7 to turn the holder 71 by several degrees (for example, about 1°) based on positional information of the encoder 79 (operation "ST8"). As a result, the first position 6A of the optical sensor 6 is finely adjusted and an irradiation angle of the illumination light is also finely adjusted.

Next, the control part 8 drives the optical sensor 6 to perform reading operation which reads the code 2*b* of the card 2 again (operation "ST9"). In a case that information having been read by the optical sensor 6 is transmitted to the host apparatus, the control part 8 determines that reading of information from the card 2 has been normally performed (operation "ST10": "Yes"). Next, the control part 8 drives the card conveyance mechanism 5 to convey the card 2 toward the card discharge port 10 (operation "ST7"). As a result, issue of the card 2 is completed.

In a case that the information having been read by the optical sensor 6 is not transmitted to the host apparatus, the control part 8 determines that reading of information from the card 2 has failed (operation "ST10": "No"). In this case, the control part 8 drives the card conveyance mechanism 5 to convey the card 2 toward the collection part 30 (operation "ST11"). As a result, collection of the card 2 is completed.

In this embodiment, when the optical sensor 6 is not used, in order to prevent dust from adhering to the reading face 60 of the optical sensor 6, the turning mechanism 7 turns the optical sensor 6 to the second position 6B. Specifically, when a main power supply of the card issuing device 1 is turned off, the control part 8 drives the turning mechanism 7 to turn the optical sensor 6 to the second position 6B. Further, even in a case that a main power supply of the card issuing device 1 is not turned off, it may be structured that, each time issue of a card 2 is completed, the control part 8 drives the turning mechanism 7 to turn the optical sensor 6 to the second position 6B. In addition, even in a case that a main power supply of the card issuing device 1 is not turned off, when issue of a card 2 is not performed for a predetermined time period, it may be structured that the control part 8 drives the turning mechanism 7 to turn the optical sensor 6 to the second position 6B. According to these structures, when the optical sensor 6 is not used, the reading face 60 of the optical sensor 6 is directed to the "Z1" direction side and thus, dust can be prevented from adhering to the reading face 60 of the optical sensor 6.

Operations and Effects

In the card issuing device 1 in this embodiment, the optical sensor 6 is located on the "Z1" direction side with respect to the card conveyance passage 50. Therefore, the optical sensor 6 is capable of reading a card 2 in which a code 2*b* is indicated on its rear face 2*a*. Further, the dust adhesion prevention mechanism 9 is a turning mechanism 7 structured to turn the optical sensor 6 between the first position 6A where the reading face 60 of the optical sensor 6 is directed to the "Z2" direction side and the second position 6B where the reading face 60 is directed to the "Z1" direction side. The turning mechanism 7 is capable of setting the reading face 60 of the optical sensor 6 to the first position 6A where the reading face 60 is directed upward when the optical sensor 6 is used and, when the optical sensor 6 is not used, the turning mechanism 7 is capable of setting the reading face 60 of the optical sensor 6 to the second position 6B where the reading face 60 is directed downward. Therefore, when the optical sensor 6 is not used, the reading face 60 of the optical sensor 6 is directed downward and thus, dust can be restrained from adhering to the reading face 60 of the optical sensor 6. As a result, optical performance of the optical sensor 6 can be restrained from being lowered due to dust. Further, the turning mechanism 7 turns the optical sensor 6 from the first position 6A to the second position 6B and thus, dust adhered to the reading face 60 of the optical sensor 6 when the optical sensor 6 is used can be dropped downward.

In this embodiment, the turning mechanism 7 includes the holder 71 which holds the optical sensor 6 and the drive part 72 which turns the holder 71 between the first position 6A and the second position 6B with the turning axis "L" as a center. The holder 71 is provided with the protruded part 761 which is protruded to an outer side in the radial direction with respect to the turning axis "L". The optical sensor 6 includes the flexible wiring board 61 which is extended to an outer side in the radial direction. The flexible wiring board 61 is fixed to the protruded part 761. Therefore, the flexible wiring board 61 is fixed to the protruded part 761 and thus, when the holder 71 is turned, a force applied to the flexible wiring board 61 can be restrained from applying to a root of the flexible wiring board 61. As a result, the flexible wiring board 61 can be restrained from disengaging from the optical sensor 6.

In this embodiment, the holder 71 is provided with the bent part 762 which is bent from a tip end portion of the protruded part 761 in a circumferential direction with respect to the turning axis "L". When the holder 71 is turned from the first position 6A to the second position 6B, the flexible wiring board 61 is bent along the bent part 762. Therefore, when the turning mechanism 7 turns the holder 71, the bent part 762 functions as a guide for bending the flexible wiring board 61 and thus, the flexible wiring board 61 is easily bent.

In this embodiment, the card issuing device 1 includes the position detection sensor 11 for detecting that the optical sensor 6 is located at the first position 6A and the second position 6B, and the control part 8 which drives and controls the card send-out mechanism 4, the card conveyance mechanism 5, the optical sensor 6 and the turning mechanism 7. The control part 8 controls the turning mechanism 7 based on a detection result of the position detection sensor 11. The control part 8 drives the optical sensor 6 to read a code when the position detection sensor 11 detects that the optical sensor 6 is located at the first position 6A. Therefore, a position of the optical sensor 6 can be detected by the position detection sensor 11 and thus, in comparison with a structure that a position of the optical sensor 6 is detected by using a stepping motor or the like provided in the turning mechanism 7, control and structure can be simplified. Further, the control part 8 is capable of driving the optical sensor 6 based on a detection result of the position detection sensor 11 and thus, the optical sensor 6 can be easily driven and controlled.

In this embodiment, in a case that the optical sensor 6 is driven to perform a reading operation of a code 2*b*, when reading of the code 2*b* has failed, the control part 8 drives the turning mechanism 7 to turn the holder 71 for finely adjusting the first position 6A of the optical sensor 6 and then, the control part 8 drives the optical sensor 6 to read the code 2*b* again. Therefore, a reading direction of the optical sensor 6 can be finely adjusted and thus, when the optical sensor 6 reads the code 2*b* again, failure of reading of the code 2*b* can be restrained.

Second Embodiment

Figure 10:
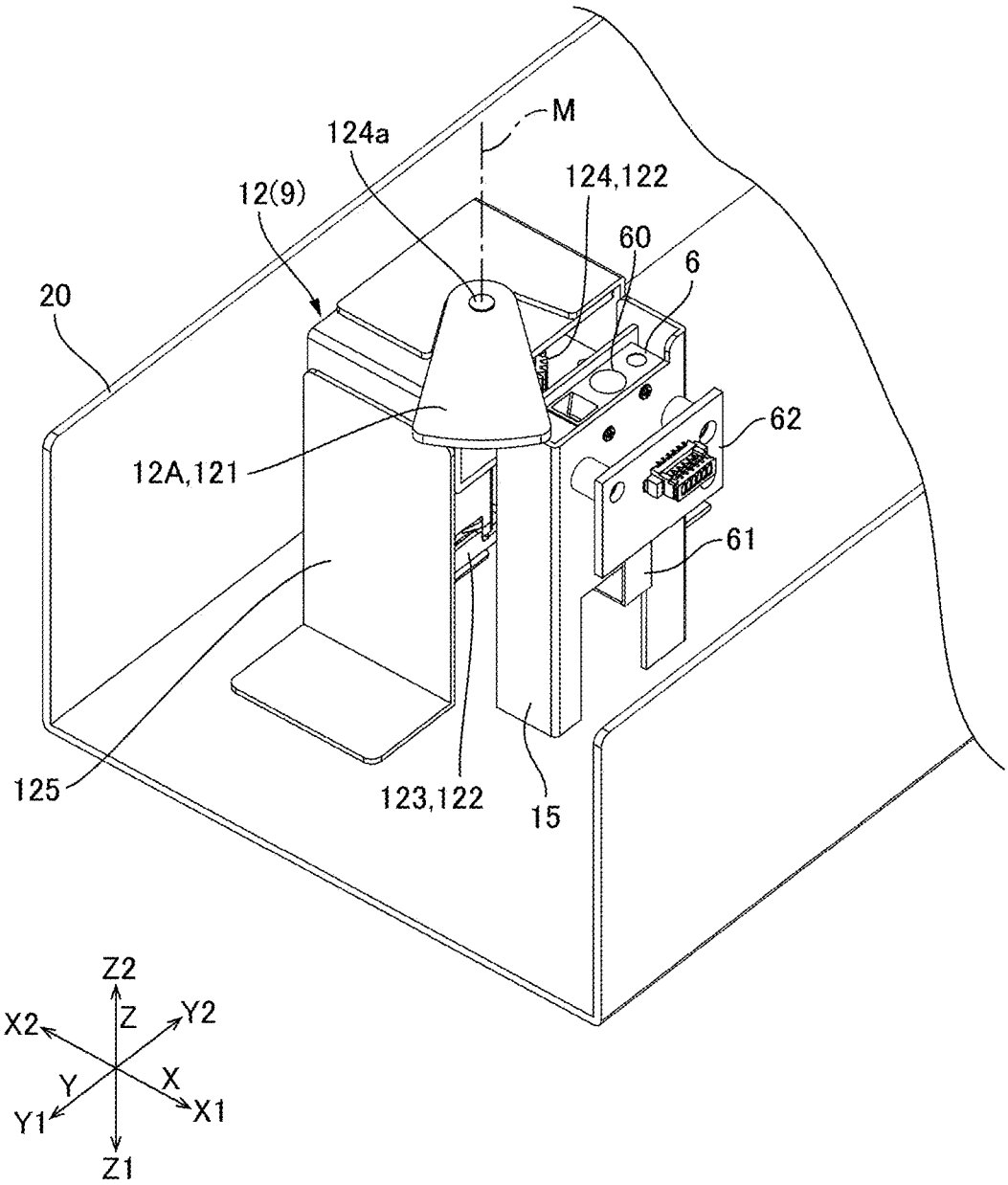
FIG. 10 is a view showing a state that a shutter mechanism has moved a shading member to a first position.
Figure 11:
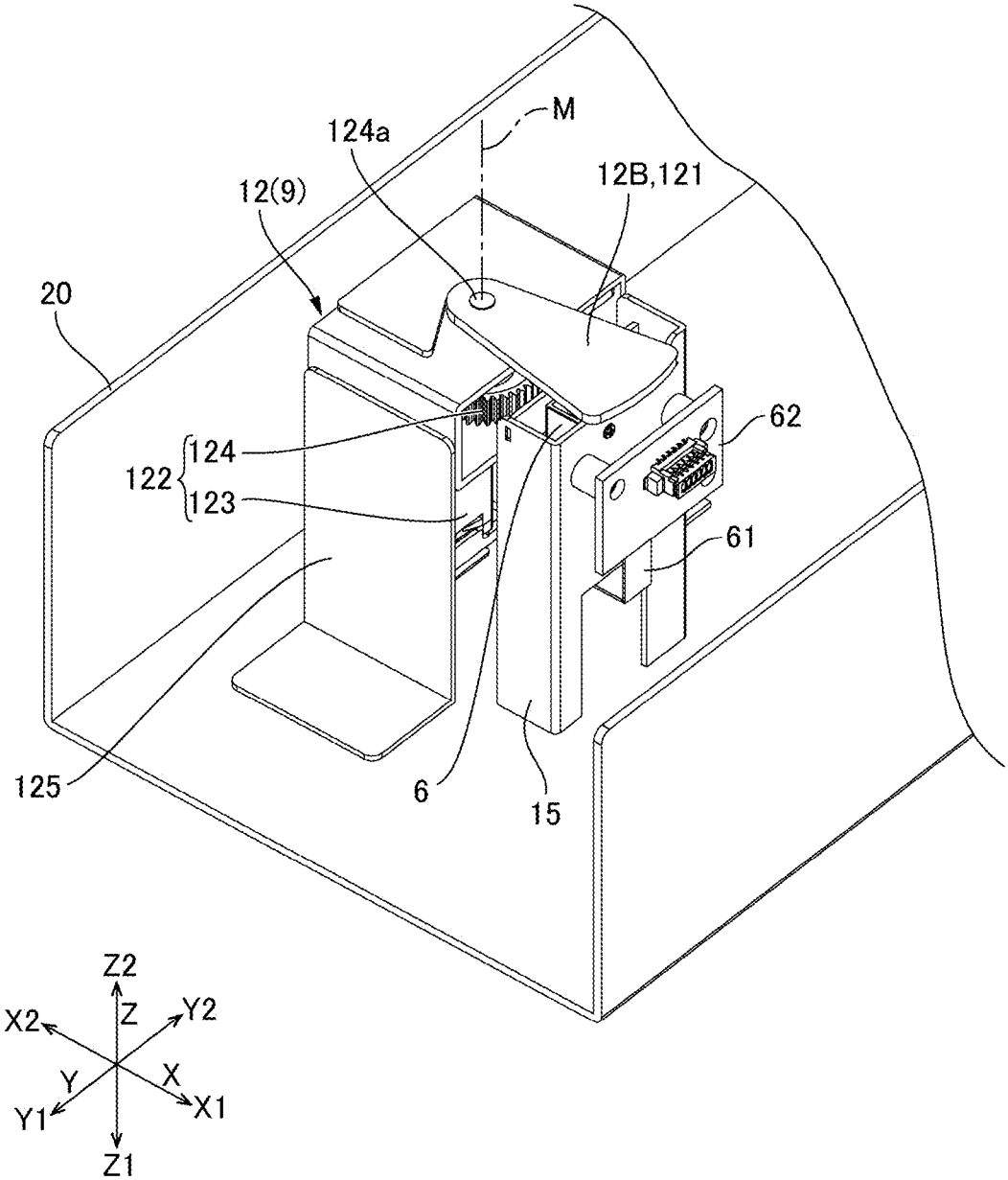
FIG. 11 is a view showing a state that a shutter mechanism has moved a shading member to a second position.

Next, a dust adhesion prevention mechanism 9 in a second embodiment of the present invention will be described below. The dust adhesion prevention mechanism 9 in the second embodiment is a shutter mechanism 12 which is different from the dust adhesion prevention mechanism 9 in the first embodiment. Therefore, in the second embodiment, the same reference signs are used in the same structures as the first embodiment and their descriptions may be omitted. FIG. 10 is a view showing a state that a shutter mechanism 12 has moved a shading member 121 to a first position 12A. FIG. 11 is a view showing a state that the shutter mechanism 12 has moved the shading member 121 to a second position.

As shown in FIG. 10 and FIG. 11, an optical sensor 6 is fixed to a support member 15 by a screw in a state that a reading face 60 is directed to the "Z2" direction side. A dust adhesion prevention mechanism 9 is located on the "Y1" direction side with respect to the optical sensor 6 and is fixed to a support member 125. The support member 125 is fixed to a base member 20. In this embodiment, the dust adhesion prevention mechanism 9 is a shutter mechanism 12 structured to move a shading member 121 between a first position 12A where a reading face 60 of the optical sensor 6 is exposed and a second position 12B where the reading face 60 is covered. The shutter mechanism 12 includes the shading member 121 and a drive part 122 which turns the shading member 121 with a turning axis "M" extended in the "Z" direction as a center. The drive part 122 includes a motor 123 and an output gear 124 which is engaged with a pinion gear of the motor 123. An end part of a shaft part 124*a* of the output gear 124 is connected with the shading member 121. A drive force of the motor 123 is transmitted to the shading member 121 through the output gear 124 and thereby, the shading member 121 is moved between the first position 12A and the second position 12B.

The control part 8 controls the card send-out mechanism 4, the card conveyance mechanism 5, the optical sensor 6 and the shutter mechanism 12. When the optical sensor 6 is used, the control part 8 drives the shutter mechanism 12 to move the shading member 121 to the first position 12A where the reading face 60 is exposed. When the optical sensor 6 is not used, the control part 8 drives the shutter mechanism 12 to move the shading member 121 to the second position 12B where the reading face 60 is covered by the shading member 121. Therefore, when the optical sensor 6 is not used, the reading face 60 of the optical sensor 6 is covered by the shading member 121 and thus, dust can be prevented from adhering to the reading face 60 of the optical sensor 6.

OTHER EMBODIMENTS

In a case that an integrated circuit (IC) chip is provided in a card 2, the card issuing device may include a reader which is capable of reading and writing to the IC chip. Further, in a case that printing is performed on a surface of a card 2, the card issuing device may include a printing part.

The card conveyance mechanism 5 is not limited to the above-mentioned structure. For example, in a case that the card issuing device 1 includes a plurality of card storage parts 3 and a plurality of card send-out mechanisms 4 arranged in the "Y" direction, the card conveyance mechanism 5 may include a carriage capable of moving in the "Y" direction along a card conveyance passage for receiving a card 2 which is sent out from the respective card send-out mechanisms 4. In this case, the optical sensor 6 may be disposed on the "Z1" direction side with respect to the card conveyance passage where the carriage is moved.

In a case that the holder 71 is turned from the second position 6B to the first position 6A, the optical sensor 6 may include a flexible wiring board 61 which is capable of bending along the bent part 762.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A card issuing device for using with a plurality of cards, the card issuing device comprising:

a card storage part which accommodates the plurality of cards;

a card send-out mechanism structured to send out a card among the plurality of cards from the card storage part;

a card conveyance mechanism structured to convey the card sent out by the card send-out mechanism toward a card discharge port along a card conveyance passage connected with the card discharge port;

an optical sensor structured to be disposed on a lower side with respect to the card conveyance passage and read a code indicated on a rear face of the card; and a dust adhesion prevention mechanism comprising a turning mechanism, wherein;

the turning mechanism comprises a holder structured to hold the optical sensor and a drive part structured to turns the holder between a first position where the reading face of the optical sensor is directed to an upper side and a second position where the reading face is directed to a lower side with a turning axis as a center;

the holder comprises a protruded part protruded to an outer side in a radial direction with respect to the turning axis, the optical sensor comprises a flexible wiring board extended to the outer side in the radial direction, and the flexible wiring board is fixed to the protruded part;

when the optical sensor is not used, the turning mechanism turns the holder and the reading face of the optical sensor is set at the second position to prevent dust from adhering to the reading face of the optical sensor; and when the optical sensor is used, the reading face of the optical sensor is set at the first position by the turning mechanism and the reading face of the optical sensor is directed to the upper side and the optical sensor reads the code indicated on the rear face of the card.

2. The card issuing device according to claim 1, wherein the holder further comprises a bent part structured to be is bent from a tip end portion of the protruded part in a circumferential direction with respect to the turning axis, and when the holder is turned from the first position to the second position or, when the holder is turned from the second position to the first position, the flexible wiring board is bent along the bent part.

3. The card issuing device according to claim 2, further comprising:

a position detection sensor structured to detect that the optical sensor is disposed at the first position and the second position; and a control part structured to drive and control the card send-out mechanism, the card conveyance mechanism, the optical sensor and the turning mechanism, wherein the control part controls the turning mechanism based on a detection result of the position detection sensor, and when the position detection sensor detects that the optical sensor is disposed at the first position, the control part drives the optical sensor to read the code.

4. The card issuing device according to claim 3, wherein the control part drives the turning mechanism to turn the holder for finely adjusting the first position of the optical sensor and drives the optical sensor to read the code again in a case that the optical sensor has failed to read the code during the control part drives the optical sensor to perform a reading operation of the code.

5. The card issuing device according to claim 1, further comprising:

a position detection sensor structured to detect that the optical sensor is disposed at the first position and the second position; and a control part structured to drive and controls the card send-out mechanism, the card conveyance mechanism, the optical sensor and the turning mechanism, wherein the control part controls the turning mechanism based on a detection result of the position detection sensor, and when the position detection sensor detects that the optical sensor is disposed at the first position, the control part drives the optical sensor to read the code.

6. The card issuing device according to claim 5, wherein the control part drives the turning mechanism to turn the holder for finely adjusting the first position of the optical sensor and drives the optical sensor to read the code again in a case that the optical sensor has failed to read the code during the control part drives the optical sensor to perform a reading operation of the code.

7. A card issuing device comprising:

a card storage part which accommodates a plurality of cards;

a card send-out mechanism structured to send out a card from the card storage part;

a card conveyance mechanism structured to convey the card sent out by the card send-out mechanism toward a card discharge port along a card conveyance passage connected with the card discharge port;

an optical sensor structured to be located on a lower side with respect to the card conveyance passage and reads a code indicated on a rear face of the card; and a dust adhesion prevention mechanism structured to prevent dust from adhering to a reading face of the optical sensor when the optical sensor is not used, wherein the dust adhesion prevention mechanism is a shutter mechanism, the shutter mechanism comprises:

a shading member structured to be is moved between a first position where the reading face of the optical sensor is exposed and a second position where the reading face is covered so as to prevent dust from adhering to the reading face of the optical sensor; and a drive part structured to move the shading member between the first position and the second position;

the drive part comprises a motor and an output gear structured to be driven by the motor and be connected with the shading member;

a drive force of the motor is transmitted to the shading member through the output gear wherein the shading member is moved between the first position and the second position; and when the optical sensor is to be used, the shading member is moved from the second position to the first position by the motor and thereby, the reading face of the optical sensor is exposed and the optical sensor reads the code indicated on the rear face of the card from the lower side with respect to the card conveyance passage.

* * * * *